US006945517B2

(12) United States Patent
Augur

(10) Patent No.: US 6,945,517 B2
(45) Date of Patent: Sep. 20, 2005

(54) FENCE CAPS FOR A FENCING SYSTEM

(76) Inventor: James D. Augur, 1607 Monroe St., Covington, KY (US) 41014

( * ) Notice: Subject to any disclaimer, the term of this patent is extended or adjusted under 35 U.S.C. 154(b) by 221 days.

(21) Appl. No.: 10/273,030

(22) Filed: Oct. 17, 2002

(65) Prior Publication Data

US 2004/0075089 A1 Apr. 22, 2004

(51) Int. Cl.[7] ..... E04H 2/00

(52) U.S. Cl. ..... 256/1; 256/19; 256/24; 52/242

(58) Field of Search ..... 52/716.1, 716.7, 52/716.8, 736.4, 36.1, 242; 256/1, 19, 59, 65.01, 24, 25, 65.02

(56) References Cited

U.S. PATENT DOCUMENTS

| | | | | |
|---|---|---|---|---|
| 3,037,593 A | | 6/1962 | Webster | |
| 4,202,532 A | | 5/1980 | Mills | |
| 4,999,961 A | | 3/1991 | McNary | |
| 5,542,222 A | | 8/1996 | Wilson et al. | |
| 5,664,376 A | | 9/1997 | Wilson et al. | |
| 5,702,090 A | | 12/1997 | Edgman | |
| 5,724,779 A | * | 3/1998 | Chang | 52/36.1 X |
| 5,839,240 A | | 11/1998 | Elsholz et al. | |
| 5,853,167 A | | 12/1998 | West et al. | |
| 5,974,748 A | | 11/1999 | Sciuga et al. | |
| D444,243 S | | 6/2001 | Erwin | |
| 6,345,478 B1 | * | 2/2002 | Pang | 52/242 X |
| 6,553,732 B2 | * | 4/2003 | Shaw | 52/716.1 X |
| 2003/0140591 A1 | * | 7/2003 | Scherrer et al. | 52/716.1 |

* cited by examiner

*Primary Examiner*—John R. Cottingham
(74) *Attorney, Agent, or Firm*—Wood, Herron & Evans, L.L.P.

(57) ABSTRACT

In general, the present invention includes a fence cap for covering the openings between two sides of a fence at the top of the fence and/or the end of the fence. The fence cap includes a first recess adapted to receive a first component of a fence. This first recess is defined by a first wall, a second wall, and a third wall. The first wall and the third wall are substantially parallel one to another, and the first wall and the third wall are each substantially perpendicular to the second wall. The cap further includes a second recess adapted to receive a second component of the fence. This second recess is defined by a fourth wall, a fifth wall, and a sixth wall. The fourth wall and the sixth wall are each substantially parallel one to another, and the fourth wall and the sixth wall are each substantially perpendicular to the fifth wall. In the fence cap of the present invention, the third wall and the sixth wall are substantially parallel one to another.

25 Claims, 7 Drawing Sheets

FENCE CAPS FOR A FENCING SYSTEM

FIELD OF THE INVENTION

The present invention generally concerns articles to be used as components for a fencing system.

BACKGROUND OF THE INVENTION

Many fences include sides including a plurality of members that are positioned in vertically or horizontally disposed rows. Fences may include two such sides positioned on both sides of an inner frame of the fence. In a typical fence structure, a number of central support posts, formed from 4"×4"s, for example, are located a predetermined distance one from another. At least one board, and generally a plurality of boards, such as 2"×4"s, are positioned between each of the successive central support posts in order to create the inner frame of the fence. A plurality of fence siding members may then be attached to this fence frame in order to provide the outer surface or surfaces of the fence. These siding members may be added to both sides of the fence frame. In one embodiment, these fence materials may be vinyl extruded siding such as would generally be provided as siding for a house or other building.

Materials, such as vinyl sidings, when used for two opposite sides of a fence, will be spaced from one another due to the inner frame of the fence. In such a configuration, the interior of the fence may be substantially open between the two sides and is open at its top between the two sides, and at the ends of the fence structure. These openings expose the interior of the fence to intrusion by water and moisture, and a variety of insects, such as ants, bees, wasps, hornets, other insects, and small animals. Further, when made with particular materials, the various members comprising the fence sides may be susceptible to warping, which disrupts the appearance of the fence, and may weaken the physical structure of the fence. In response to these drawbacks, caps may be provided to cover such openings in a fence. Many caps which may be used on such fencing systems are not aesthetically pleasing in that the attachment points are visible on the outside of the fence. Further, many caps are not sufficient to prevent the ingress of weather, water, moisture, or insects and small animals. Also, fence systems generally do not include caps formed to cover the openings located at the ends of fences.

Thus, there is a need for a simple yet effective barrier against water, moisture, insects, and small animal intrusion into the interior of a fence. Further, it would be desirable to provide members for a fence system which form a tight fit and are easily attached to the fence. Additionally, it would be desirable to provide members designed to cover the openings at the ends of fences. Finally, it would be desirable to provide fence members that are relatively permanent, simple to install, cost-effective, and which permit a wide range of sizes.

SUMMARY OF THE INVENTION

The present invention overcomes and eliminates the drawbacks described above by providing fence cap members which may be incorporated in a fence structure to cap the openings which may be present at the top and ends of a fence. Such a fence cap includes at least first and second recesses located on each side of the fence cap. Fence sidings may be insinuated into and received by these first and second recesses in order to facilitate the attachment of the caps to the fence and properly cover the openings at the top and ends of the fence. The fence caps of the present invention may be molded as one piece so as to provide increased strength and increased resistance against accidental disassembly of the members and further to aid in preventing ingress of water, moisture, and insect and animal life.

In general, the present invention includes a fence cap for covering the openings between two sides of a fence at the top of the fence and/or the end of the fence. The fence cap includes a first recess adapted to receive a first component of a fence. This first recess is defined by a first wall, a second wall, and a third wall. The first wall and the third wall are substantially parallel one to another, and the first wall and the third wall are each substantially perpendicular to the second wall. The cap further includes a second recess adapted to receive a second component of the fence. This second recess is defined by a fourth wall, a fifth wall, and a sixth wall. The fourth wall and the sixth wall are each substantially parallel one to another, and the fourth wall and the sixth wall are each substantially perpendicular to the fifth wall. In the fence cap of the present invention, the third wall and the sixth wall are substantially parallel one to another.

In another aspect, the present invention may provide in combination, a fence cap for covering the opening between two sides of a fence, a first component of a fence and a second component of a fence. The fence cap is that as described above, including a first recess adapted to receive the first component of the fence structure, and a second recess adapted to receive the second component of the fence structure. The first and second components may be siding components which are affixed to a fence frame.

In yet another aspect, the present invention may be a fence including a fence frame, two outer sides of a fence, with each of the outer sides affixed to the frame, and a fence cap as described above.

In order that the invention may be more clearly understood and more readily carried into effect, the same will now, by way of example, be more fully described with reference to the accompanying drawings and detailed description which follow.

DETAILED DESCRIPTION OF THE INVENTION

Figure 1:
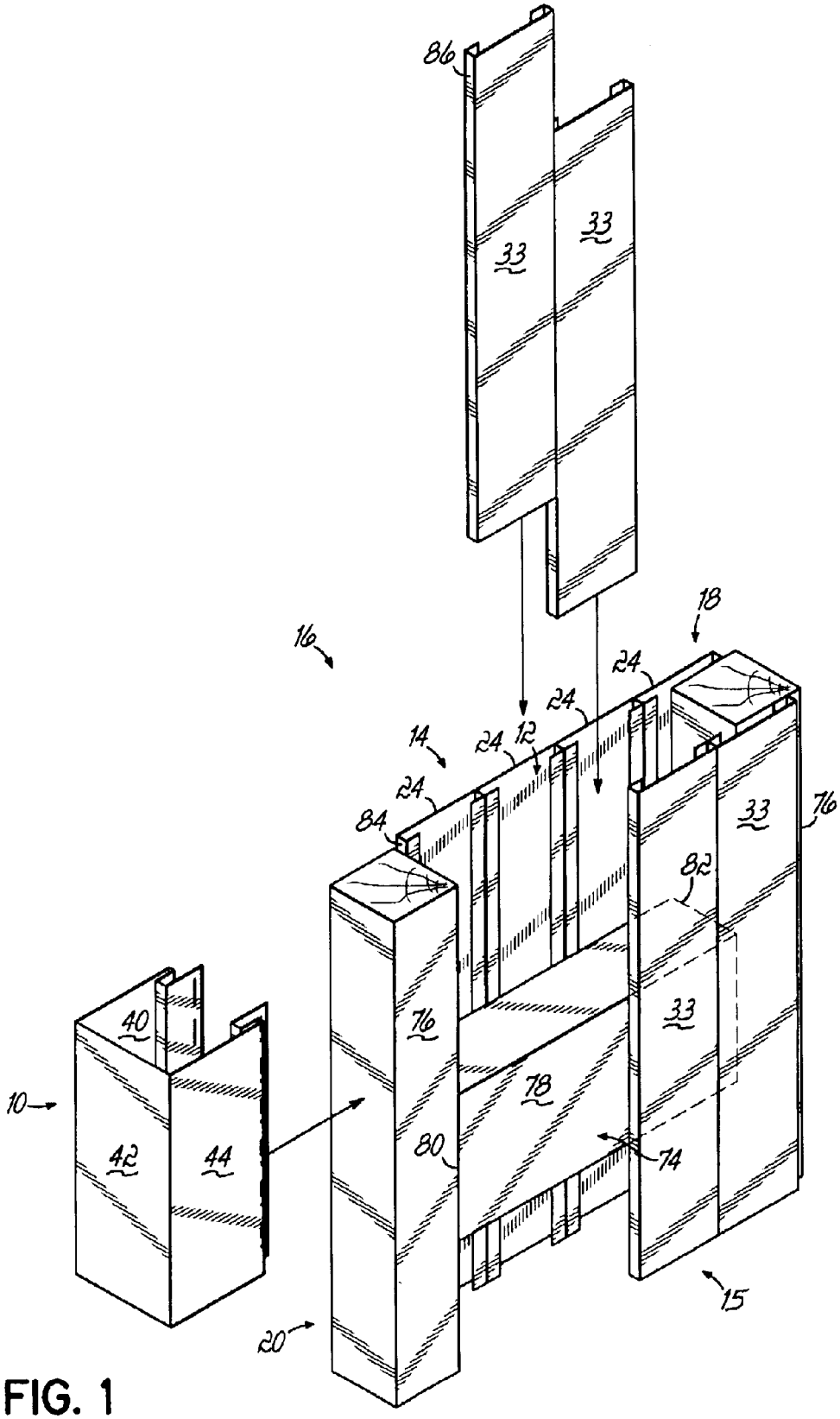
FIG. 1 is a perspective view of a fence cap in accordance with the principles of the present invention depicted with a fence having a fence frame with two sides of a fence which may be insinuated into the recesses of the fence cap.

Referring to the Figures, in general, the present invention includes a molded article to be used as a fence cap 10 for covering an opening 12 that is positioned between and defined by two sides 14, 15 of a fence 16. This opening 12 may be located at the top 18 of the fence 16 or the end 20 of the fence 16. Typically, this opening 12 runs along the length of the fence top 18 or fence end 20. The fence cap 10 includes a first recess 22 adapted to receive a first component 24 of a fence 16. This first recess 22 is defined by a first wall 26, a second wall 28, and a third wall 30. The first wall 26 and the third wall 30 are substantially parallel one to another, and the first wall 26 and the third wall 30 are each substantially perpendicular to the second wall 28. The fence cap 10 further includes a second recess 32 adapted to receive a second component 33 of the fence 16. This second recess 32 is defined by a fourth wall 34, a fifth wall 36, and a sixth wall 38. The fourth wall 34 and the sixth wall 38 are each substantially parallel one to another, and the fourth wall 34 and the sixth wall 38 are each substantially perpendicular to the fifth wall 36. In the fence cap 10 of the present invention, the third wall 30 and the sixth wall 38 are substantially parallel one to another. The third wall 30 and the sixth wall 38 may be of substantially equal lengths and, in the illustrated embodiment of the present invention, a plane bisecting the third wall 30 and perpendicular to the third wall 30 also bisects the sixth wall 38 at an angle perpendicular to the sixth wall 38.

Further, the fence cap 10 of the present invention may include an outer body having a first outer wall 40, a second outer wall 42, and a third outer wall 44. These first, second and third outer walls 40, 42, 44 may be associated with and connected to the above-described plurality of walls defining the first and second recesses 22, 32. These first, second, and third outer walls 40, 42, 44 may be directly connected or connected indirectly, as shown in the illustrated embodiment by first and second connecting walls 46, 48. The first, second, and third outer walls 40, 42, 44 may be molded integrally with the first and second connecting walls 46, 48, and the walls defining the first and second recesses 22, 32. In the illustrated embodiment, the first connecting wall 46 has first and second ends 50, 52, with the first end 50 connected to the third wall 30 and the second end 52 connected to the first outer wall 40. The third wall 30 and the first outer wall 40 are substantially parallel one to another, and the first connecting wall 46 is substantially perpendicular to the third wall 30 and the first outer wall 40. Likewise, the second connecting wall 48 has first and second ends 54, 56, with the first end 54 connected to the sixth wall 38 and the second end 56 connected to the third outer wall 44. The sixth wall 38 and the third outer wall 44 are substantially parallel one to another, and the second connecting wall 48 is substantially perpendicular to the sixth wall 38 and the second outer wall 42.

Figure 2:
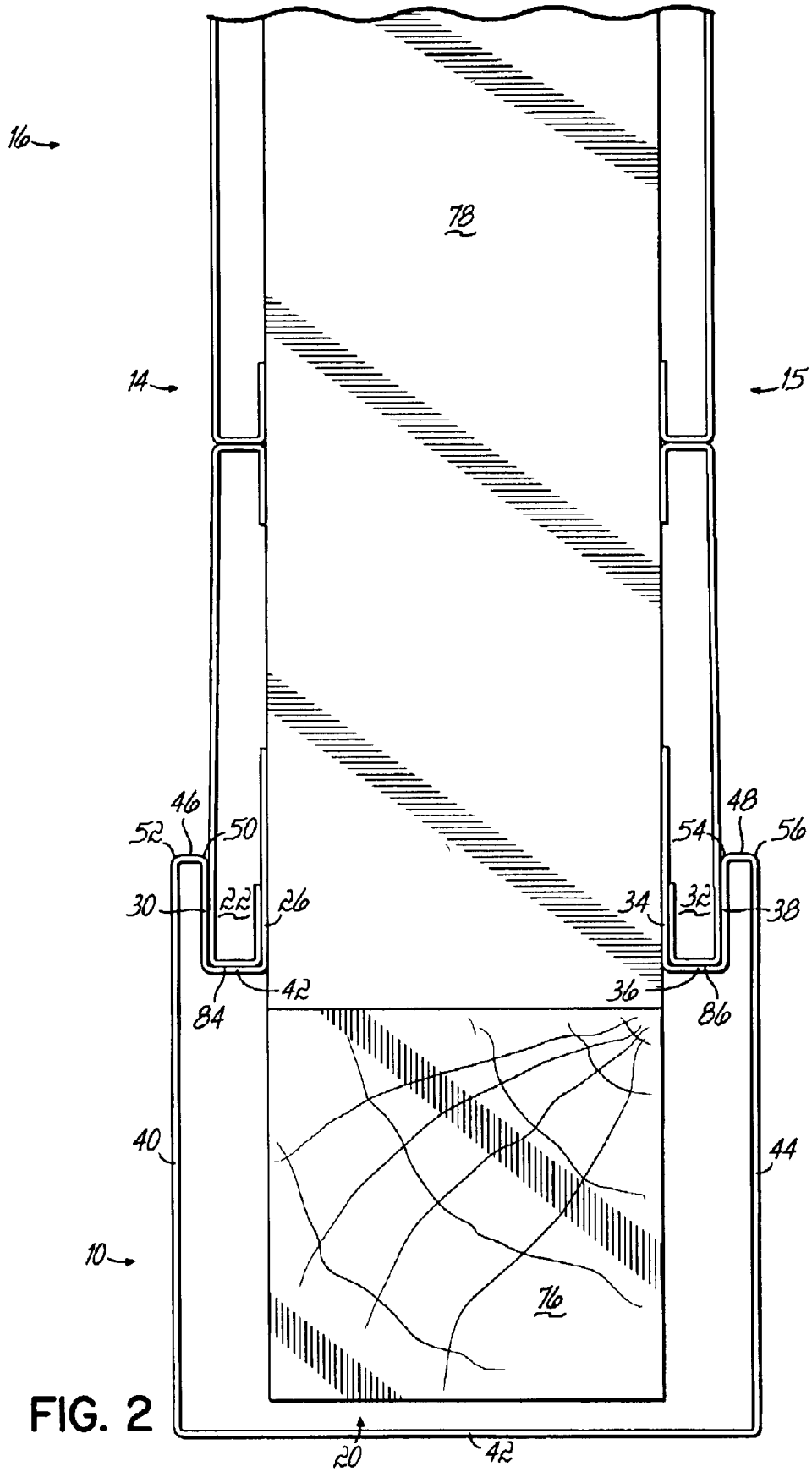
FIG. 2 is a partial top view of the fence of FIG. 1, including one embodiment of the fence cap attached to the end of the fence.
Figure 2A:
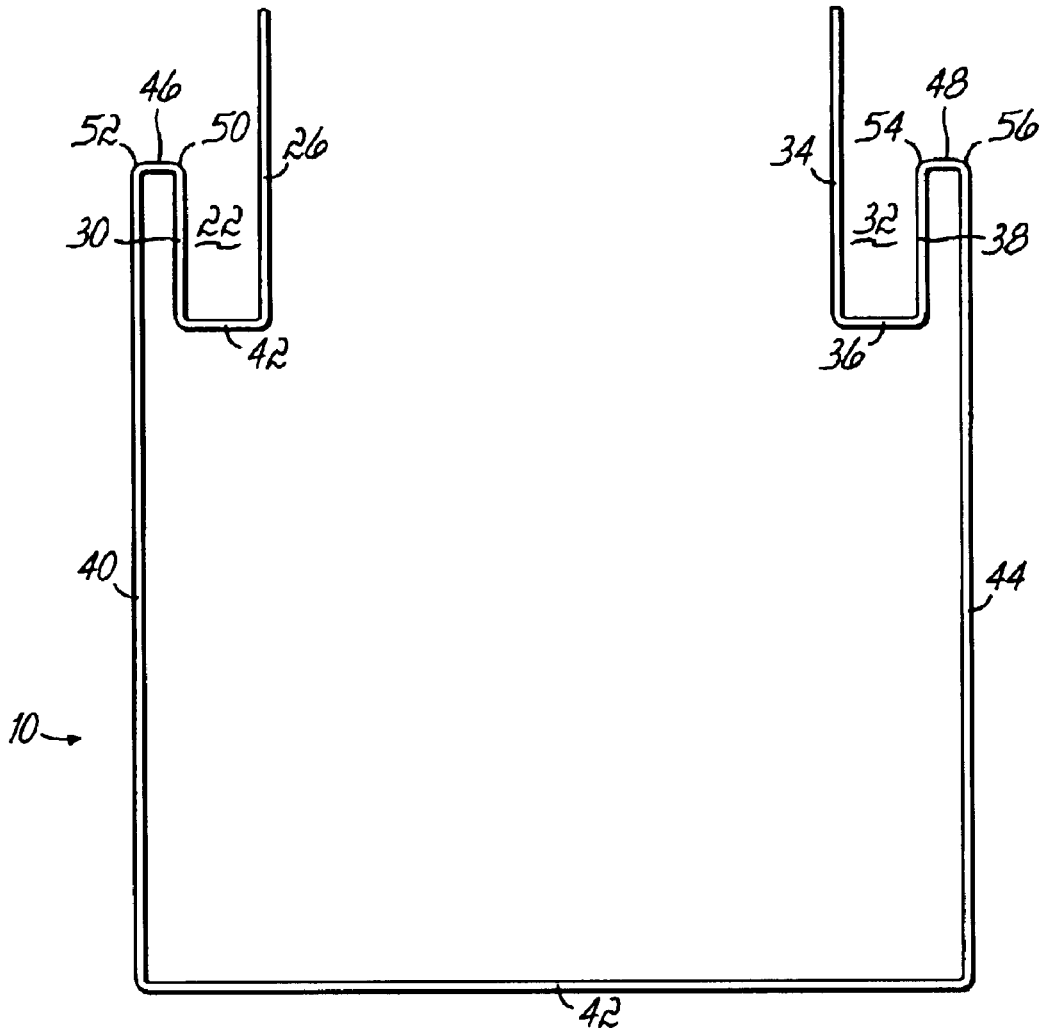
FIG. 2A is an end view of the fence cap of FIG. 1.

Referring now to FIGS. 1–2A, a first embodiment of the fence cap 10 of the present invention may be used to cover the opening 12 of a fence structure on the end of a fence 16. This embodiment includes first and second recesses 22, 32, as described above, each adapted to receive first and second components 24, 33 of a fence 16, respectively. The fence cap 10 thus includes first, second, and third walls 26, 28, 30 defining the first recess 22, wherein the first wall 26 and third wall 30 are substantially parallel one to another, and the first wall 26 and third wall 30 are each substantially perpendicular to the second wall 28. The fence cap 10 thus further includes fourth, fifth, and sixth walls 34, 36, 38, defining the second recess 32, wherein the fourth wall 34 and sixth wall 38 are substantially parallel one to another, and the fourth wall 34 and the sixth wall 38 are each substantially perpendicular to the fifth wall 36. The third wall 30 and the sixth wall 38 are substantially parallel one to another.

The embodiment of the fence cap 10 illustrated in FIGS. 1, 2, and 2A also includes a first outer wall 40, a second outer wall 42, and a third outer wall 44. These first, second, and third outer walls 40, 42, 44 are associated with the first and second recesses 22, 32 by way of a first connecting wall 46 and a second connecting wall 48. In the particular embodiment as illustrated, the first outer wall 40 and third outer wall 44 are substantially parallel one to another and the first outer wall 40 and third outer wall 44 are substantially perpendicular to the second outer wall 42.

Figure 3:
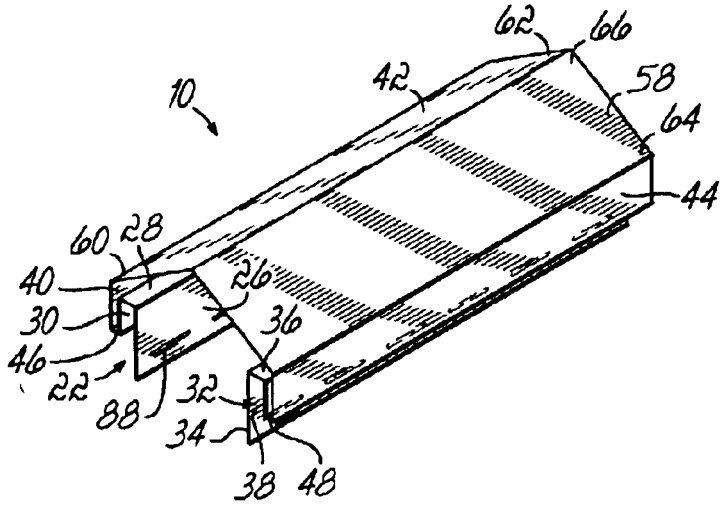
FIG. 3 is a perspective view of an alternate embodiment of a fence cap of the present invention for a top of a fence structure.
Figure 4:
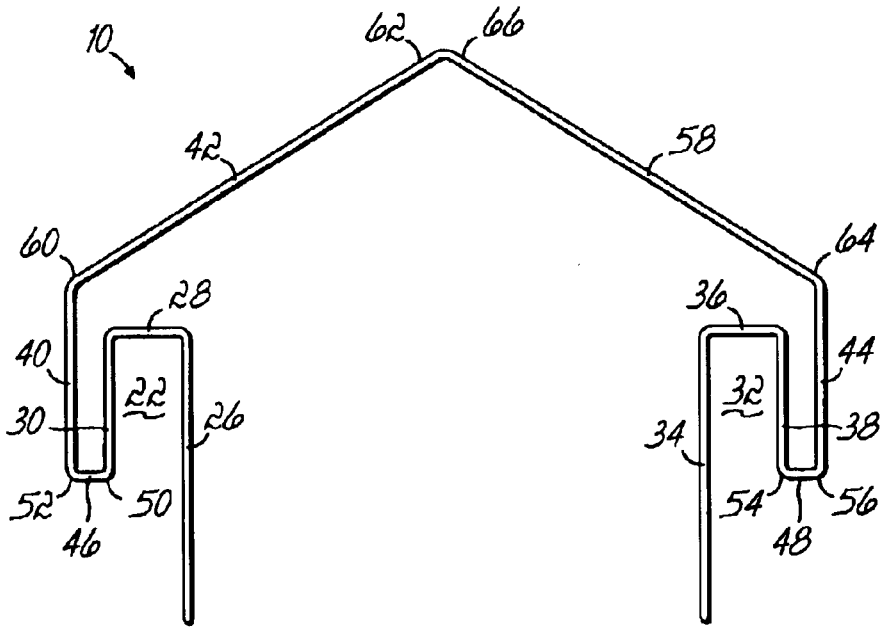
FIG. 4 is an end view of the fence cap of FIG. 3.

Referring now to FIGS. 3–4, a second embodiment of the fence cap 10 of the present invention may be used to cover the opening 12 of a fence structure on the top 18 of a fence 16. In this illustrated embodiment, like components are represented by like numbers. This embodiment includes first and second recesses 22, 32, as described above, adapted to receive first and second components 24, 33 of a fence 16. The fence cap 10 thus includes first, second, and third walls 26, 28, 30 defining the first recess 22, wherein the first wall 26 and third wall 30 are substantially parallel one to another, and the first wall 26 and third wall 30 are each substantially perpendicular to the second wall 28. The fence cap 10 thus further includes fourth, fifth, and sixth walls 34, 36, 38 defining the second recess 32, wherein the fourth wall 34 and sixth wall 38 are substantially parallel one to another, and the fourth wall 34 and the sixth wall 38 are each substantially perpendicular to the fifth wall 36. The third wall 30 and the sixth wall 38 are substantially parallel one to another.

The embodiment illustrated in FIGS. 3 and 4 also includes a first outer wall 40, a second outer wall 42, a third outer wall 44, and a fourth outer wall 58. In the illustrated embodiment, these first, second, third, and fourth outer walls 40, 42, 44, 58 are associated with the first and second recesses 22, 32 by way of a first connecting wall 46 and a second connecting wall 48. In the particular embodiment as illustrated, the first outer wall 40 and second outer wall 42 are substantially parallel one to another. The third and fourth outer walls 44, 58 each have first and second ends with the first end 60 of the third outer wall 44 being connected to the first outer wall 40 and the first end 64 of the fourth outer wall 58 being connected to the second outer wall 42. The second end 62 of the third outer wall 44 is connected to the second end 66 of the fourth outer wall 58 and the third and fourth outer walls 44, 58 are positioned such that they are angled one to another. In the illustrated embodiment, the third and fourth outer walls 44, 58 are joined at an angle of greater than 90 degrees. However, it will be recognized that the third and fourth outer walls 44, 58 could be disposed at any angle relative to one another.

Figure 5:
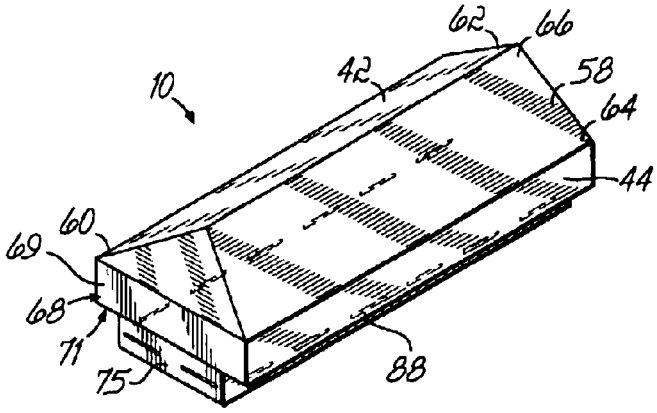
FIG. 5 is a perspective view of a fence cap having a closed end for a top of a fence structure in accordance with the principles of the present invention.
Figure 6:
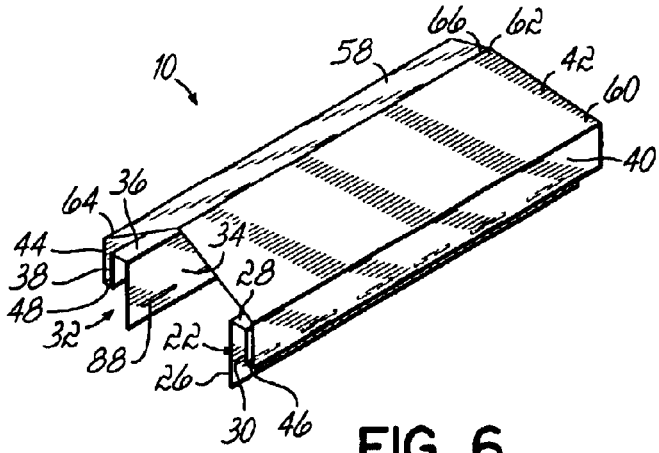
FIG. 6 is a perspective view of the fence cap of FIG. 5 depicting the opposite open end of the fence cap.
Figure 7:
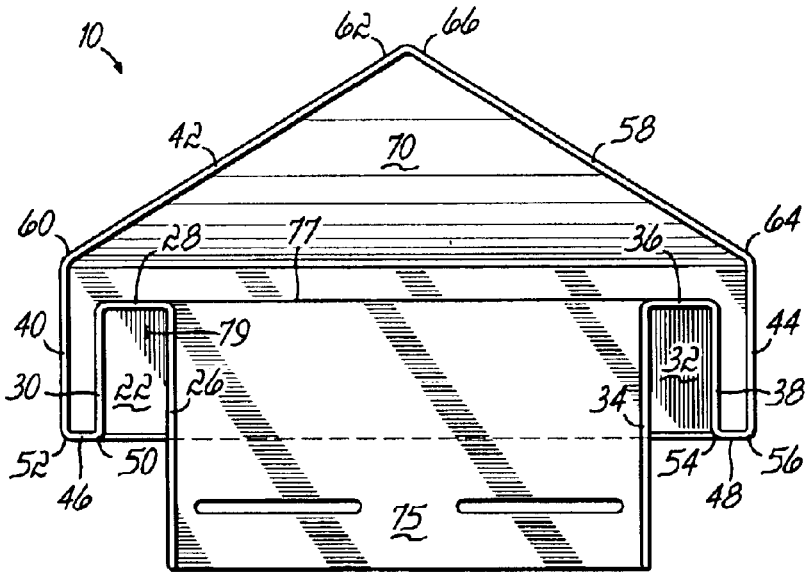
FIG. 7 is an end view of the fence cap of FIG. 5 taken from the open end of the fence cap.

Referring now to FIGS. 5–7, a third embodiment of the present invention may be used to cover the opening 12 of a fence structure on the top 18 of a fence 16 proximal to the end 20 of a fence section. In the illustrated embodiment, like components are represented by like numbers. This embodiment includes first and second recesses 22, 32, as described above, adapted to receive first and second components 24, 33 of a fence 16. The article thus includes first, second, and third walls 26, 28, 30 defining the first recess 22, wherein the first wall 26 and third wall 30 are substantially parallel one to another, and the first wall 26 and third wall 30 are each substantially perpendicular to the second wall 28. The article thus further includes fourth, fifth, and sixth walls 24, 36, 38, defining the second recess 32, wherein the fourth wall 34 and sixth wall 38 are substantially parallel one to another, and the fourth wall 34 and the sixth wall 38 are each substantially perpendicular to the fifth wall 36. The third wall 30 and the sixth wall 38 are substantially parallel one to another.

The embodiment illustrated in FIGS. 5–7 also includes a first outer wall 40, a second outer wall 42, a third outer wall 44, and a fourth outer wall 58. These first, second, third, and fourth outer walls 40, 42, 44, 58 are associated with the first and second recesses 22, 32 by way of a first connecting wall 46 and a second connecting wall 48. In the particular embodiment as illustrated, the first outer wall 40 and second outer wall 42 are substantially parallel one to another. The third and fourth outer walls 44, 58 each have first and second ends with the first end 60 of the third outer wall 44 being connected to the first outer wall 40 and the first end 64 of the fourth outer wall 58 being connected to the second outer wall 42. The second end 62 of the third outer wall 44 is connected to the second end 66 of the fourth outer wall 58 and the third and fourth outer walls 44, 58 are positioned such that they are angled relative to one another. In the illustrated embodiment, the third and fourth outer walls 44, 58 are joined at an angle of greater than 90 degrees. However, it will be recognized that the third and fourth outer walls 44, 58 could be disposed at any angle relative to one another.

The embodiment illustrated in FIGS. 5–7 further includes an end wall 68 disposed at a first end 69 of the fence cap 10. This allows for the fence cap 10 to be positioned along the top 18 of a fence 16, with the end wall 68, and thus the closed end, positioned proximal to the end 20 of the fence 16. The end wall 68, in the illustrated embodiment, is molded as an integral part of the fence cap 10 such that it is connected to the first, second, third, fourth, fifth, and sixth walls 26, 28, 30, 34, 36, 38; the first, second, third, and fourth outer walls 40, 42, 44, 58, and the first and second connecting walls 46, 48. The end wall 68 further includes a third recess 71 adapted to receive a third component (not shown) of a fence 16. Alternatively, the third recess might receive a second outer wall 42 of a fence cap 10, such as that of the first embodiment of the present invention, when such a fence cap 10 is affixed to the end of a fence 16 (see FIG. 8). This third recess 71 is defined by a seventh wall 75, an eighth wall 77, and a ninth wall 79, with the seventh wall 75 and ninth wall 79 being substantially parallel one to another and substantially perpendicular to the eighth wall. As shown, the end wall 68 of the illustrated embodiment may include a sloped portion 70. However, this sloped portion 70 is not necessary to the fence cap 10 of the present invention and it will be appreciated that other configurations may be used.

Figure 8:
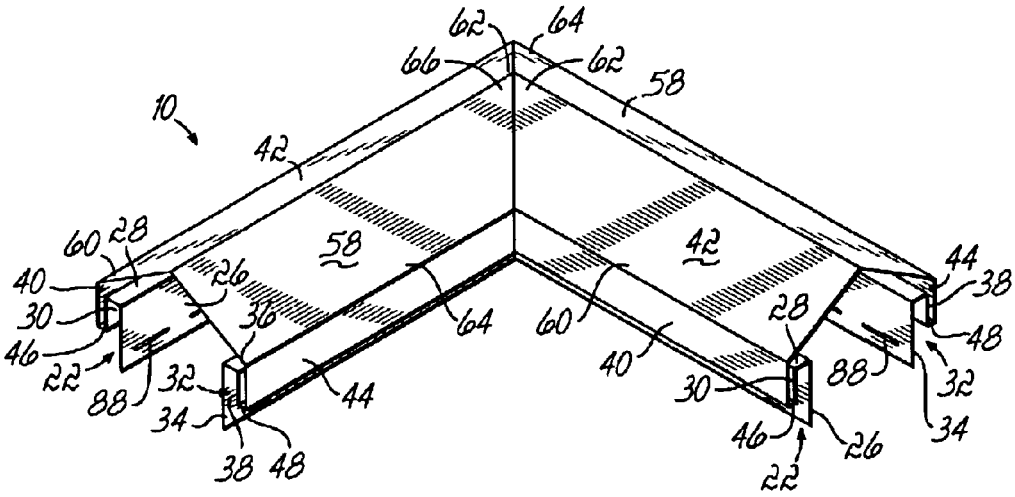
FIG. 8 is a perspective view of a fence cap for a corner of a fence at the top of a fence structure in accordance with the principles of the present invention.
Figure 9:
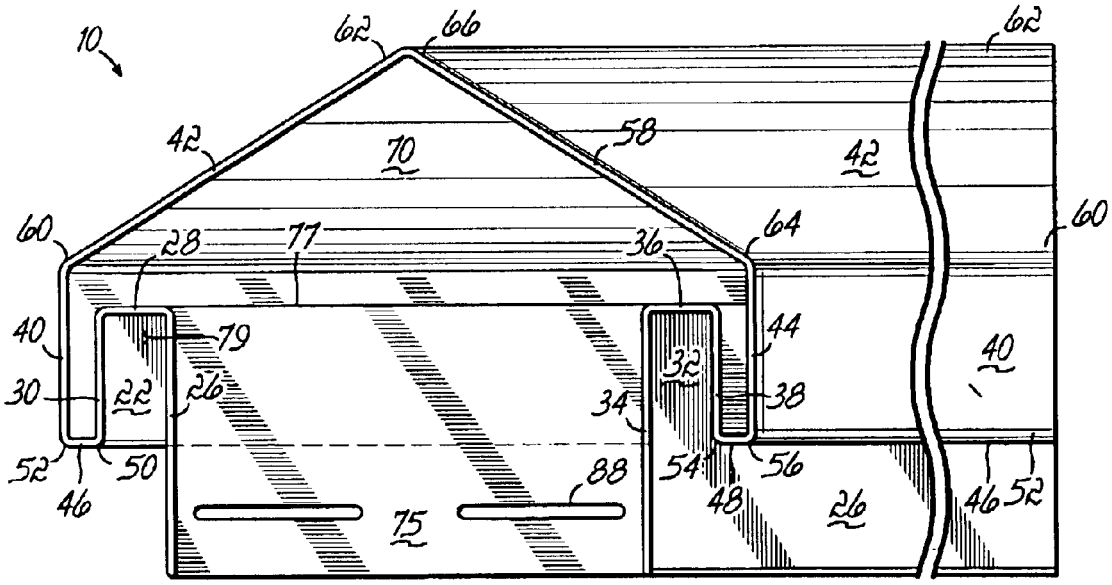
FIG. 9 is an end view of the fence cap of FIG. 8 taken from an open end of the fence cap.

Referring now to FIGS. 8 and 9, a fourth embodiment of the fence cap 10 of the present invention may be used to cover the opening 12 of a fence structure on the top 18 of a fence 16, at the corner of a fence 16. In this illustrated embodiment, like components are represented by like numbers. This embodiment includes first and second recesses 22, 32, as described above, adapted to receive first and second components 24, 33 of a fence 16. The fence cap 10 thus includes first, second, and third walls 26, 28, 30 defining the first recess 22, wherein the first wall 26 and third wall 30 are substantially parallel one to another, and the first wall 26 and third wall 30 are each substantially perpendicular to the second wall 28. The fence cap 10 thus further includes fourth, fifth, and sixth walls 34, 36, 38 defining the second recess 32, wherein the fourth wall 34 and sixth wall 38 are substantially parallel one to another, and the fourth wall 34 and the sixth wall 38 are each substantially perpendicular to the fifth wall 36. The third wall 30 and the sixth wall 38 are substantially parallel one to another.

As this fourth embodiment of the fence cap covers the opening 12 on the top 18 of a fence 16 at the corner of the fence, the embodiment may be made, in one aspect, by two top fence caps 10 (as would be depicted in FIGS. 3 and 4) with one end of each cut at a 45° angle in order to confront one another at the corner of the fence 16. Alternatively, such a corner fence cap 10 may be molded as a single article in order to be associated with the opening at the top 18 of a fence 16 at the corner of the fence 16. While the illustrated embodiment depicts a corner fence cap 10 suitable for association with a corner of a fence 16 having an angle of 90°, it will be recognized by those having skill in the relevant art that the fence cap 10 does not have to match a 90° corner, but may be fabricated to match any particular angle that may be present on the corner of a fence 16.

While the illustrated embodiments of the present invention are of a particularly described configuration, it will be recognized by those having skill in the art that other outer shapes and features may be present on the fence caps of the present invention without detracting from the principles of the present invention. For example, the first outer wall 40 and the third outer wall 44 may include a lip (not shown) positioned proximal to the juncture of the first outer wall 40 and first connecting wall 46 and also positioned proximal to the juncture of the third outer wall 44 and the second connecting wall 48. This lip is defined by a section of the first outer wall 40 and/or third outer wall 44 which bows in an outwardly direction from the interior of the fence cap 10.

Figure 10:
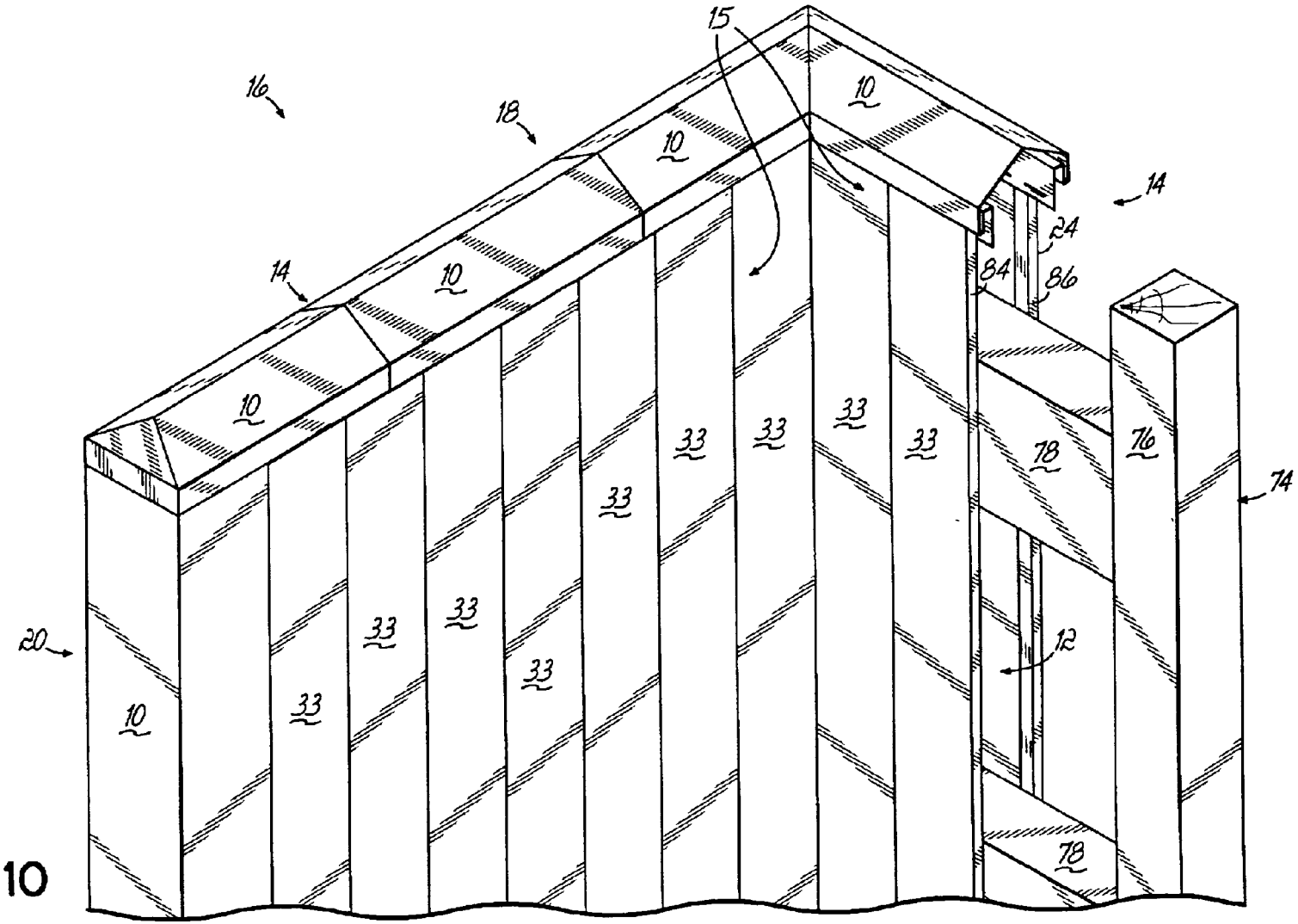
FIG. 10 is a perspective environmental view of a plurality of fence caps in accordance with the principles of the present invention associated with one another and other components of a fencing system.

Referring now to FIGS. 1 and 10, the present invention may also be provided in a combination to facilitate the formation of a fence 16. Thus, the present invention may provide in combination, a fence cap 10 for covering the opening 12 between two sides 14, 15 of a fence 16 structure, a first component 24 of a fence 16 and a second component 33 of a fence 16.

The fence cap 10 is that as described above, generally including a first recess 22 adapted to receive the first component 24 of the fence 16, and a second recess 32 adapted to receive the second component 33 of the fence 16. The first recess 22 is defined by a first wall 26, a second wall 28, and a third wall 30. The first wall 26 and the third wall 30 are substantially parallel one to another, and the first wall 26 and the third wall 30 are each substantially perpendicular to the second wall 28. The second recess 32 is defined by a fourth wall 34, a fifth wall 36, and a sixth wall 38. The fourth wall 34 and the sixth wall 38 are each substantially parallel one to another, and the fourth wall 34 and the sixth wall 38 are each substantially perpendicular to the fifth wall 36. Finally, the third wall 30 and the sixth wall 38 are substantially parallel one to another.

The first and second components 24, 33 may be materials to form outer sides 14, 15 of a fence 16 which are affixed to a fence frame 74. These components may be wood, metal, plastic, such as vinyl, or any other material which may be used to form a side of a fence 16. In one particular embodiment, these components may be vinyl siding, such as that as would be found in the construction of buildings, such as houses. The siding components may be affixed to a fence frame 74 by being positioned in either a horizontal (not shown) or a vertical orientation. The sides 14, 15 will generally include end portions 72 which extend from the top and ends of a fence frame 74. Normally, these first and second components 24, 33 will be affixed to the fence frame 74 on opposite sides of the fence frame 74. Thus, these components define the interior of the fence 16 which is to be covered by the embodiments of the fence cap 10 of the present invention.

In one aspect, the first embodiment of the fence cap 10 of the present invention may be used and attached at the end 20 of a fence 16 in order to cover the opening 12 formed at the side end 20 of the fence 16. In another aspect, the second embodiment of the fence cap 10 of the present invention may be used and attached at the top 18 of a fence 16 in order to cover the opening 12 formed at the top 18 of a fence 16. In yet another aspect, the third embodiment of the fence cap 10 of the present invention may be used and attached at the top 18 of the fence 16 near an end 20 of the fence 16 in order to cover the opening 20 at the top 18 of the fence 16, while at the same time preventing the ingress of any elements, water, moisture, insects, etc. from the side at the top end of the fence 16. In the third embodiment, this is accomplished by the presence of the end wall 68 of the fence cap 10 as described above. The methods of attachment of the fence cap 10 of the present invention will be described in greater detail below.

Referring now to FIGS. 1, 2A, and 10, a fence 16, to which the fence cap 10 of the present invention may be attached, generally includes an inner fence frame 74, two outer sides 14, 15 of the fence 16 which are operatively connected to the fence frame 74, and fence caps 10 to cover the openings 12 at the tops 18 and ends 20 of the fence 16. The fence frame 74, in the illustrated embodiment, is formed from a plurality of posts 76 spaced a predetermined distance one from another, and intermediate boards 78 positioned in between each two of the posts 76. Each intermediate board 78 includes a first end 80 and a second end 82, and is positioned with the first end 80 attached to a first post and a second end 82 attached to a second post. In the embodiment illustrated in FIG. 1, one intermediate board 78 is positioned between each two of the posts 76. However, it is not necessary that one board be used and it will be appreciated that any number of intermediate boards 78 may be positioned between two posts 76. The intermediate boards 78 may be attached to the posts 76 by nails, bolts, screws, adhesives, notches on the ends of the boards and sides of the posts 76, or by any other method apparent to those of skill in the art. The outer sides of the fence 16 are then attached to the outside of the fence frame 74 such that the fence frame 74 is not visible in a completed fence 16. As can be seen from the illustrated embodiment, openings 12 may be present between the two outer sides of the fence 16 at least (1) along the top 18 of the fence 16 and (2) at the ends 20 of the fence 16. These openings 12 are covered by the various embodiments of the fence cap 10 of the present invention.

In the illustrated embodiment of the fence 16, the first and second components 24, 33 are disposed in a vertical manner along the inner frame of the fence 16. In such an embodiment, the inner frame must be made such that the intermediate boards 78 are disposed in a horizontal configuration. This allows a frame for the first and second components 24, 33 to be attached to the horizontal intermediate boards 78 of the frame. In an alternate embodiment (not shown), the first and second components of the fence may be disposed in a horizontal configuration. In such an alternate embodiment, the inner frame of the fence must be configured such that intermediate boards are positioned in a vertical direction to lend support and points of attachment to the horizontally disposed first and second components of the fence.

In one aspect, a first end portion 84 of the first component 24 may be positioned between the first wall 26 and the third wall 30 such that the first end portion 84 of the first component 24 is insinuated into the first recess 22 of the fence cap 10. This first end portion 84 of the first component 24 may extend from the side of the fence 16, and the fence cap 10 may be that of the first embodiment of the present invention. Alternatively, this end portion 84 may extend from the top 18 of the fence 16, and the fence cap 10 may be that of either the second or the third embodiment of the present invention. Additionally, a first end portion 86 of the second component 33 may be positioned between the fourth wall 34 and the sixth wall 38 such that the first end portion 86 of the second component 33 is insinuated into the second recess 32 of the fence cap 10. This first end portion 86 of the second component 33 may extend from the side of the fence 16, and the fence cap 10 may be that of the first embodiment of the present invention. Alternatively, this end portion 86 may extend from the top 18 of the fence 16, and the fence cap 10 may be that of either the second or the third embodiment of the present invention. In the combination of the present invention, the first end portion 84 of the first component 24 may confront the second wall 28 and the first end portion 86 of the second component 33 may confront the fifth wall 36. Additionally, the first end 84 of the first component 24 and the first end 86 of the second component 33 may be affixed to the third wall 30 and the sixth wall 38 respectively. This affixation may occur by fasteners, such as nuts, bolts, screws, nails, or any other fastener apparent to one of skill in the art. In such an embodiment, the first wall 26 and the fourth wall 34 each include at least one orifice 88 for receiving the fastener. In one particular embodiment of the present invention, the orifice 88 may be sized to be larger than the fastener to be disposed through the orifice 88. This allows the fence caps 10 to be attached to the sides 14, 15 of the fence 16, while allowing for a certain degree of movement to occur as the components of the fence 16 expand and contract due to variables, such as temperature fluctuations. Alternatively, the fence cap 10 of the present invention may be made of material, such as vinyl or other plastics, which are amenable to being pierced by the fastener. Alternatively, the fence cap 10 may be affixed by an adhesive. In yet another embodiment, the fence cap 10 may be affixed to the first and second components 24, 33 of the fence 16 by a friction fit.

In an alternate embodiment, a first side portion of the first component 24 may be positioned between the first wall 26 and the third wall 30 such that it is insinuated into the first recess 22. This first side portion of the first component 24 may extend from the side of the fence 16, and the article may be that of the first embodiment of the present invention. Alternatively, this side portion may extend from the top of the fence 16, and the article may be that of either the second or the third embodiment of the present invention. Additionally, a first side portion of the second component 33 may be positioned between the fourth wall 34 and the sixth wall 38 such that it is insinuated into the second recess 32. This first side portion of the second component 33 may extend from the side of the fence 16, and the article may be that of the first embodiment of the present invention. Alternatively, this side portion may extend from the top of the fence 16, and the article may be that of either the second or the third embodiment of the present invention. In the combination of the present invention, the first side portion of the first component 24 may confront the second wall 28 and the first side portion of the second component 33 may confront the fifth wall 36. Additionally, the first side of the first component 24 and the first side of the second component 33 may be affixed to the third wall 30 and the sixth wall 38 respectively. This affixation may occur by fasteners, such as nuts, bolts, screws, nails, or any other fastener apparent to one of skill in the art. In such an embodiment, the first wall 26 and the fourth wall 34 each include at least one orifice 88 for receiving the fastener. Alternatively, the fence cap 10 of the present invention may be made of material, such as vinyl or other plastics, which are amenable to being pierced by the fastener. Alternatively, the articles may be affixed by an adhesive. In yet another embodiment, the fence cap 10 may be affixed to the first and second components of the fence 16 by a friction fit.

In order to complete a fence 16 of the present invention, the fence 16 may also include inner and outer vinyl corner wraps, and molding, such as would be provided a J-channel, disposed along the bottom of the fence. Molding such as J-channels and inner and outer corner wraps are commercially available from Wolverine® Siding Systems.

Because the vinyl siding pieces forming the exterior first and second components 24, 33 of the fence 16 are attached to the inner frame 74 of the fence 16, the fence 16 has a interior hollow space between the two sides 14, 15. Due to the use of vinyl and/or other plastics, this fence structure allows for electrical wires and/or pipes for plumbing to be safely run along the interior of the fence 16 and exiting through the sides 14, 15 of the fence 16 where needed.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A fence cap for covering an opening between two sides of a fence, the fence cap comprising:

a single-piece frame including a first recess adapted to receive a first component of a fence, said first recess being defined by a first wall, a second wall, and a third wall, said first wall and said third wall being substantially parallel one to another, and said first wall and said third wall each being substantially perpendicular to said second wall, said first recess having a first longitudinal axis, said first longitudinal axis being substantially parallel to and disposed between said first wall and said third wall;

a second recess adapted to receive a second component of said fence, said second recess being defined by a fourth wall, a fifth wall, and a sixth wall, said fourth wall and said sixth wall being substantially parallel one to another, and said fourth wall and said sixth wall each being substantially perpendicular to said fifth wall, said second recess having a second longitudinal axis, said second longitudinal axis being substantially parallel to and disposed between said fourth wall and said sixth wall; and a first outer wall, wherein at least a portion of said first outer wall is disposed outside of an area defined between said first longitudinal axis and said second longitudinal axis:

wherein said third wall and said sixth wall are substantially parallel one to another.

2. The fence cap of claim 1, further comprising a second outer wall, and a third outer wall, wherein said first outer wall is connected to and is substantially parallel to said third wall, and wherein said third outer wall is connected to and is substantially parallel to said sixth wall.

3. The fence cap of claim 2, wherein said second outer wall is connected to one of said first outer wall and said third outer wall.

4. The fence cap of claim 3, further comprising a fourth outer wall having first and second ends, with said first end of said fourth outer wall connected to said second outer wall, and said second end of said fourth outer wall connected to the other end of said first outer wall and said third outer wall.

5. The fence cap of claim 2, wherein said first outer wall is connected to said third wall by a first connecting wall, said first connecting wall having first and second ends, with said first end of said first connecting wall connected to said third wall and said second end of said first connecting wall connected to said first outer wall.

6. The fence cap of claim 5, wherein said third outer wall is connected to said sixth wall by a second connecting wall, said second connecting wall having first and second ends, with said first end of said second connecting wall connected to said sixth wall and said second end of said second connecting wall connected to said third outer wall.

7. The fence cap of claim 1, further comprising at least one orifice disposed through one of said first wall and said fourth wall.

8. The fence cap of claim 1, further comprising a third recess being defined by a seventh wall, an eighth wall, and a ninth wall, said seventh wall and said ninth wall being substantially parallel one to another, and said seventh wall and said ninth wall each being substantially perpendicular to said eighth wall, wherein said seventh wall and said ninth wall are substantially perpendicular to said first wall, said third wall, said fourth wall, and said sixth wall.

9. In combination, a fence cap for covering an opening between two sides of a fence, the fence cap comprising a single piece frame including a first recess adapted to receive a first component of said fence, said first recess being defined by a first wall, a second wall, and a third wall, said first wall and said third wall being substantially parallel one to another, and said first wall and said third wall each being substantially perpendicular to said second wall,said first recess having a first longitudinal axis, said first longitudinal axis being substantially parallel to and disposed between said first wall and said third wall, and a second recess adapted to receive a second component of said fence, said second recess being defined by a fourth wall, a fifth wall, and a sixth wall, said fourth wall and said sixth wall being substantially parallel one to another, and said fourth wall and said sixth wall each being substantially perpendicular to said fifth wall, wherein said third wall and said sixth wall are substantially parallel one to another, said second recess having a second longitudinal axis, said second longitudinal axis being substantially parallel to and disposed between said fourth wall and said sixth wall;

a first outer wall, wherein at least a portion of said first outer wall is disposed outside of an area defined between said first longitudinal axis and said second longitudinal axis;

a first component of a fence; and a second component of a fence.

10. The combination of claim 9, further comprising a second outer wall, and a third outer wall, wherein said first outer wall is connected to and is substantially parallel to said third wall, and wherein said third outer wall is connected to and is substantially parallel to said sixth wall.

11. The combination of claim 10, wherein said second outer wall is connected to one of said first outer wall and said third outer wall.

12. The fence cap of claim 11, further comprising a fourth outer wall having first and second ends, with said first end of said fourth outer wall connected to said second outer wall, and said second end of said fourth outer wall connected to the other end of said first outer wall and said third outer wall.

13. The combination of claim 10, wherein said first outer wall is connected to said third wall by a first connecting wall, said first connecting wall having first and second ends, with said first end of said first connecting wall connected to said third wall and said second end of said first connecting wall connected to said first outer wall.

14. The combination of claim 13, wherein said third outer wall is connected to said sixth wall by a second connecting wall, said second connecting wall having first and second ends, with said first end of said second connecting wall connected to said sixth wall and said second end of said second connecting wall connected to said third outer wall.

15. The fence cap of claim 11, further comprising a fourth outer wall connected to said second outer wall.

16. The combination of claim 9, further comprising at least one orifice disposed through one of said first wall and said fourth wall.

17. The combination of claim 9, wherein an end portion of said first component is positioned between said first wall and said fourth wall.

18. The combination of claim 16, wherein an end portion of said second component is positioned between said fourth wall and said sixth wall.

19. The combination of claim 17, wherein said end portion of said first component confronts said second wall and said end portion of said second component confronts said fifth wall.

20. The combination of claim 17, wherein said first component and said second component are affixed to said third wall and said sixth wall respectively.

21. The combination of claim 9, wherein a side portion of said first component is positioned between said first wall and said fourth wall.

22. The combination of claim 20, wherein a side portion of said second component is positioned between said fourth wall and said sixth wall.

23. The combination of claim 20, wherein said side portion of said first component confronts said second wall and said side portion of said second component confronts said fifth wall.

24. The combination of claim 20, wherein said first component and said second component are affixed to said third wall and said sixth wall respectively.

25. A fence system comprising:

a fence frame;

a first outer side and a second outer side, each of said first and second outer sides being affixed to said fence frame and defining an opening between said first and second outer sides; and a fence cap for covering said opening, the cap comprising a single-piece frame including a first recess adapted to receive said first outer side, said first recess being defined by a first wall, a second wall, and a third wall, said first wall and said third wall being substantially parallel one to another, and said first wall and said third wall each being substantially perpendicular to said second wall, said first recess having a first longitudinal axis, said first longitudinal axis being substantially parallel to and disposed between said first wall and said third wall, and a second recess adapted to receive said second outer side, said second recess being defined by a fourth wall, a fifth wall, and a sixth wall, said fourth wall and said sixth wall being substantially parallel one to another, and said fourth wall and said sixth wall each being substantially perpendicular to said fifth wall, said second recess having a second longitudinal axis, said second longitudinal axis being substantially parallel to and disposed between said fourth wall and said sixth wall, and a first outer wall, wherein at least a portion of said first outer wall is disposed outside of an area defined between said first longitudinal axis and said second longitudinal axis: wherein said third wall and said sixth wall are substantially parallel one to another.

* * * * *

UNITED STATES PATENT AND TRADEMARK OFFICE

CERTIFICATE OF CORRECTION

PATENT NO. : 6,945,517 B2
DATED : September 20, 2005
INVENTOR(S) : James D. Augur It is certified that error appears in the above-identified patent and that said Letters Patent is hereby corrected as shown below:

Column 8,
Line 47, “which are” should be -- which is --.

Column 9,
Line 13, “which are” should be -- which is --.
Line 13, “applicants” should be -- applicant --.

Column 10,
Line 50, “wall,said” should be -- wall, said --.

Column 12,
Line 42, “axis:” should be -- axis; --.

Signed and Sealed this

Twenty-first Day of March, 2006

JON W. DUDAS
*Director of the United States Patent and Trademark Office*

UNITED STATES PATENT AND TRADEMARK OFFICE

CERTIFICATE OF CORRECTION

PATENT NO. : 6,945,517 B2
APPLICATION NO. : 10/273030
DATED : September 20, 2005
INVENTOR(S) : James D. Augur It is certified that error appears in the above-identified patent and that said Letters Patent is hereby corrected as shown below:

On the cover page,

[*] Notice: Subject to any disclaimer, the term of this patent is extended or adjusted under 35 USC 154(b) by (221) days Delete the phrase "by 221" and insert -- by 341 days --

Signed and Sealed this

Eighth Day of July, 2008

JON W. DUDAS
*Director of the United States Patent and Trademark Office*